United States Patent [19]

Hankel

[11] Patent Number: 5,029,914

[45] Date of Patent: Jul. 9, 1991

[54] FITTING WITH A HANDLE FOR OPERATING THE LOCK FOLLOWER OF A LOCK FITTED IN A DOOR OR THE LIKE

[75] Inventor: Willi Hankel, Waldeck, Fed. Rep. of Germany

[73] Assignee: HEWI Heinrich Wilke GmbH, Fed. Rep. of Germany

[21] Appl. No.: 417,726

[22] Filed: Oct. 5, 1989

[30] Foreign Application Priority Data

Oct. 5, 1988 [DE] Fed. Rep. of Germany ..... 3833758

[51] Int. Cl.[5] ..... E05B 3/00

[52] U.S. Cl. ..... 292/336.3; 292/DIG. 62; 292/336.5

[58] Field of Search ..... 70/DIG. 42; 292/DIG. 62, 336.3, 336.5, 169.21, 358

[56] References Cited

U.S. PATENT DOCUMENTS

| | | | |
|---|---|---|---|
| 831,386 | 9/1906 | Simmons | 70/DIG. 42 |
| 1,446,085 | 2/1923 | Falk | 70/DIG. 42 |
| 1,495,820 | 5/1924 | Tierney | 292/DIG. 62 |
| 1,908,980 | 5/1933 | Heyel | 70/DIG. 42 |
| 1,914,704 | 6/1933 | Rightmyer | 292/336.5 |
| 2,872,236 | 2/1959 | Check | 292/336.3 |
| 3,072,427 | 1/1963 | De Vines | 292/336.3 |
| 3,337,249 | 8/1967 | Russell | 292/336.5 |
| 3,792,886 | 2/1974 | Ramsey | 292/169.18 |

*Primary Examiner*—Eric K. Nicholson
*Attorney, Agent, or Firm*—Michael J. Striker

[57] ABSTRACT

The invention relates to a fitting with a handle for operating the lock follower of a lock fitted in a door or the like. The fitting comprises a fixing device for its fixing to the door or the like and for rotary mounting of the handle, which device is passed through by an operating rod mounted without play in the follower and inserted into a receiving opening of the handle. The receiving opening is so formed that it—going from a datum position—transfers directly to the operating rod rotary movements of the handle taking place in a first direction of rotation but is without influence on the operating rod with rotary movements of the handle taking place in the opposite direction of rotation, commencing from the datum position, at least within a predetermined range of rotation. The fixing device comprises a transmission mechanism which converts rotary movements of the handle, taking place in the opposite direction of rotation, commencing from the datum position, into rotary movement of the operating rod likewise taking place in the first-mentioned direction of rotation. Accordingly it is possible to turn the follower in the sense of rotation necessary for opening the lock both through right turning and through left turning of the handle.

20 Claims, 8 Drawing Sheets

FITTING WITH A HANDLE FOR OPERATING THE LOCK FOLLOWER OF A LOCK FITTED IN A DOOR OR THE LIKE

BACKGROUND OF THE INVENTION (1) Field of the Invention

This invention relates to a fitting of the kind with a handle for operating the lock follower of a lock fitted in a door or the like, transmitting rotary movements of the handle in both directions of rotation to the lock follower.

(2) Description of the Prior Art

Locks of doors or the like can as a rule only be opened by turning the handle in a selected direction of rotation. It is however often desired and in some countries even prescribed that a door lock or the like can be opened by turning the handle both in the clockwise sense and in the anticlockwise sense. Hitherto such a double or left/right action has only been possible using a special, expensive lock construction. Since locks with a single function cannot readily be converted from the single function to the double function or vice versa, different lock constructions are always necessary for the two applications, which is undesirable, above all for reasons of cost. Moreover the subsequent conversion of a lock with single function cannot readily to a lock with the desired left/right action frequently involves difficulties, because the housing dimensions of the old and the new lock must agree which, especially when changing old locks, is frequently not possible or only with corresponding constructional expense or even with visible damage to the door or the like.

SUMMARY OF THE INVENTION

As against this the invention is based on the problem of leaving the lock construction itself unchanged and instead forming the fitting of the kind initially defined so that it allows the lock to open on turning the handle in both directions.

The fitting according to the invention has a handle for operating the lock follower of a lock fitted in a door or the like. A fixing device is provided for fixing to the door or the like and for the rotary mounting of the handle. A receiving opening is formed in the handle and an operating rod is arranged in the receiving opening and passing through the fixing device. The receiving opening is so formed that, in going from a datum position, it transfers directly to the operating rod rotary movements of the handle taking in a first direction of rotation but is without influence on the operating rod with rotary movements of the handle taking piece in the opposite direction of rotation, commencing from the datum position, at least within a predetermined range of rotation. The fixing device comprises a transmission mechanism coupled to the handle and to the operating rod, which mechanism converts rotary movements of the handle, taking place in the second direction of rotation, commencing from the datum position, into rotary movement of the operating rod likewise taking place in the first direction of rotation.

In accordance with the invention the fitting rather than the door lock makes possible the desired right/left action. According there is the essential advantage that only the fitting need be changed on conversion from the single action to the double action, the locks and hence also the lock mortices being able to stay unchanged. Since modern fittings for doors or the like are frequently made from plastics material by injection moulding, the corresponding conversion is comparatively cheap.

BRIEF DESCRIPTION OF THE DRAWINGS

The invention will be explained in more detail below with reference to an embodiment in conjunction with the accompanying drawings. These show.

FIG. a section through a door which is provided on both sides with a fitting according to the invention and has a lock mortice with a lock, of which only the lock follower is shown.

DESCRIPTION OF THE PREFERRED EMBODIMENT

Figure 1:
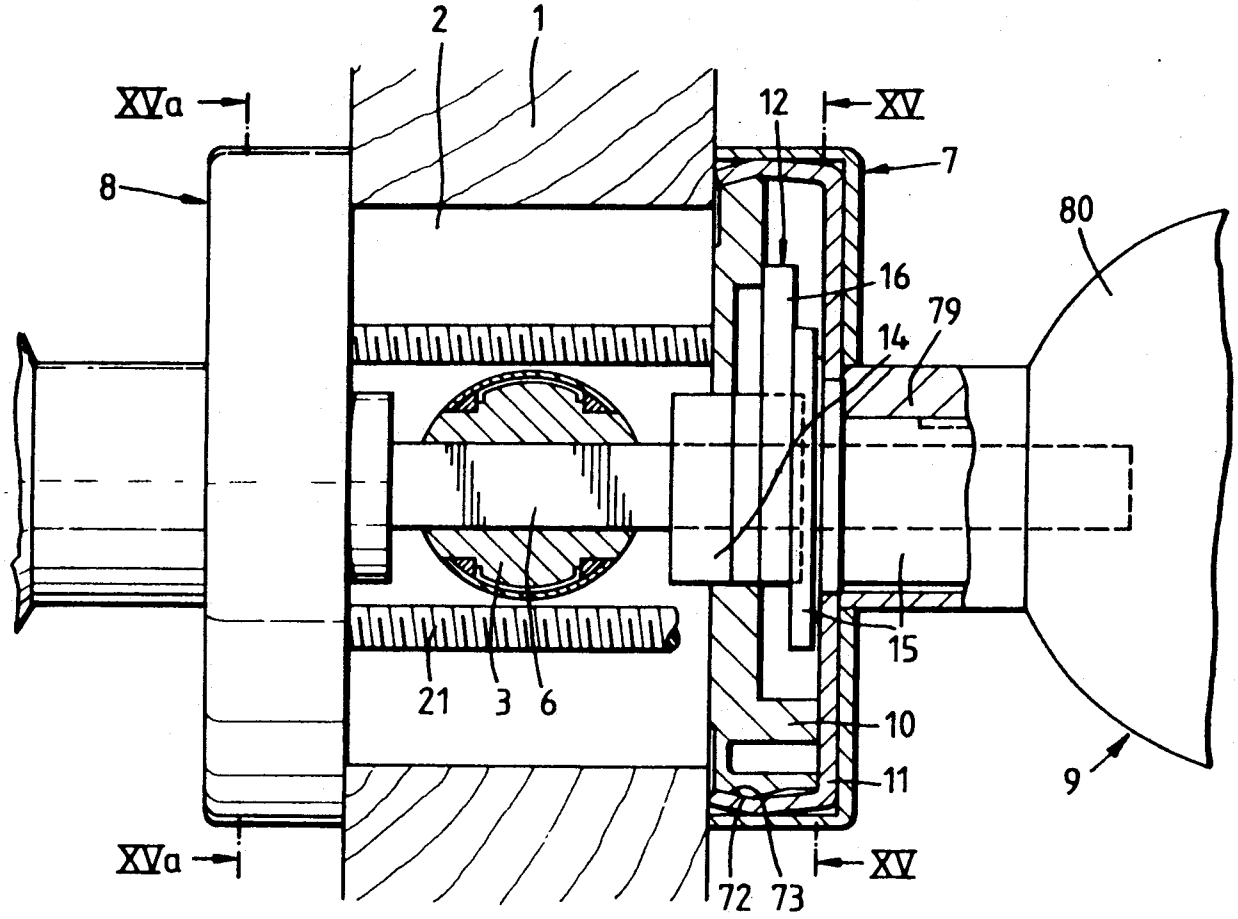
Figure 15:
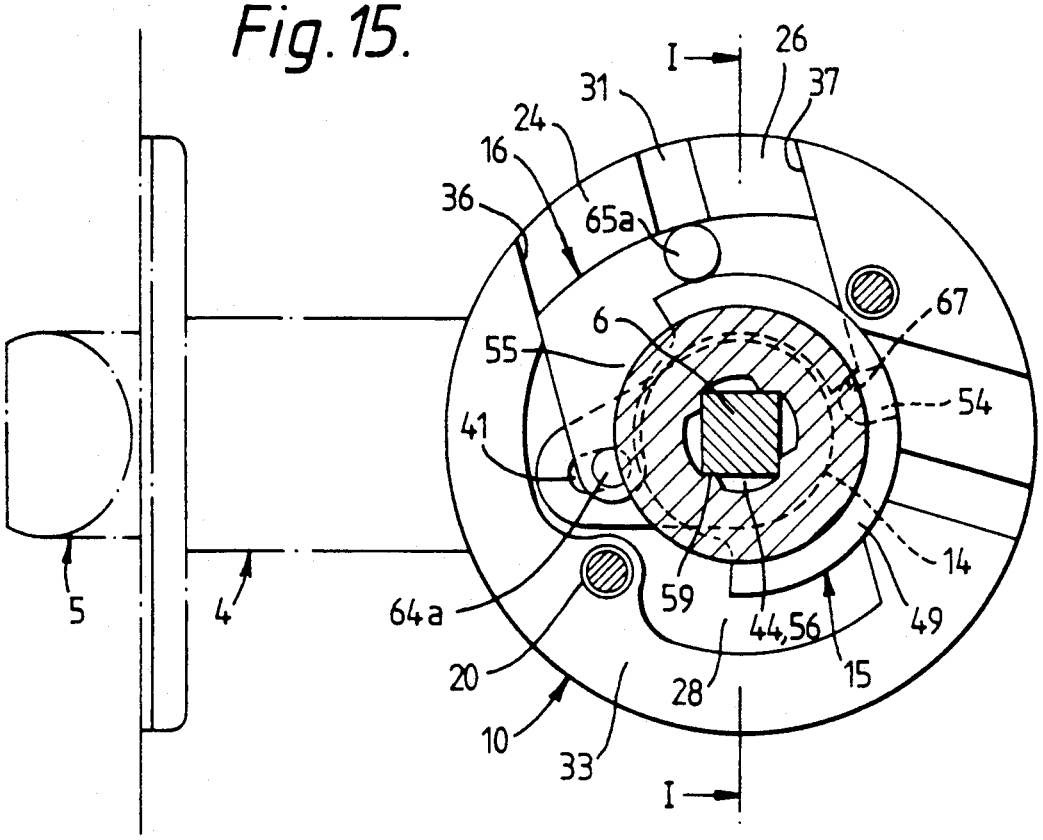
FIG. 15 a schematic plan view of the fitting approximately along the line XV—XV of FIG. 1 with the top part and cover removed, in a datum position lock follower according to FIG. 1.
Figure 16:
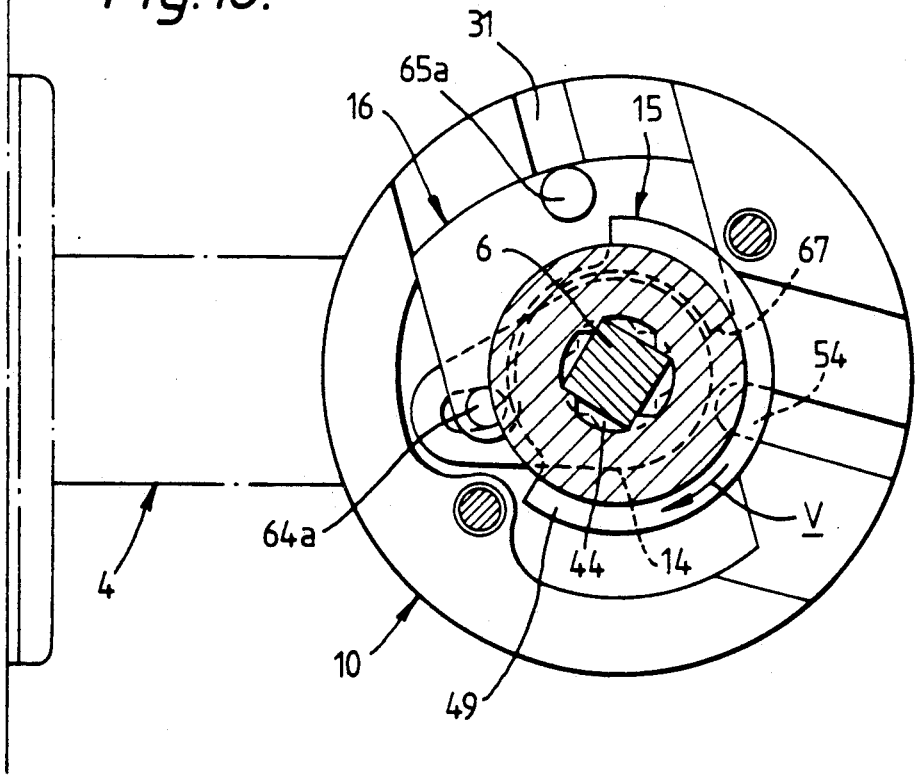
FIG. 16 a view corresponding to FIG. 15 is an open position of the lock follower according to FIG. 1 produced by turning the handle in clockwise sense.
Figure 17:
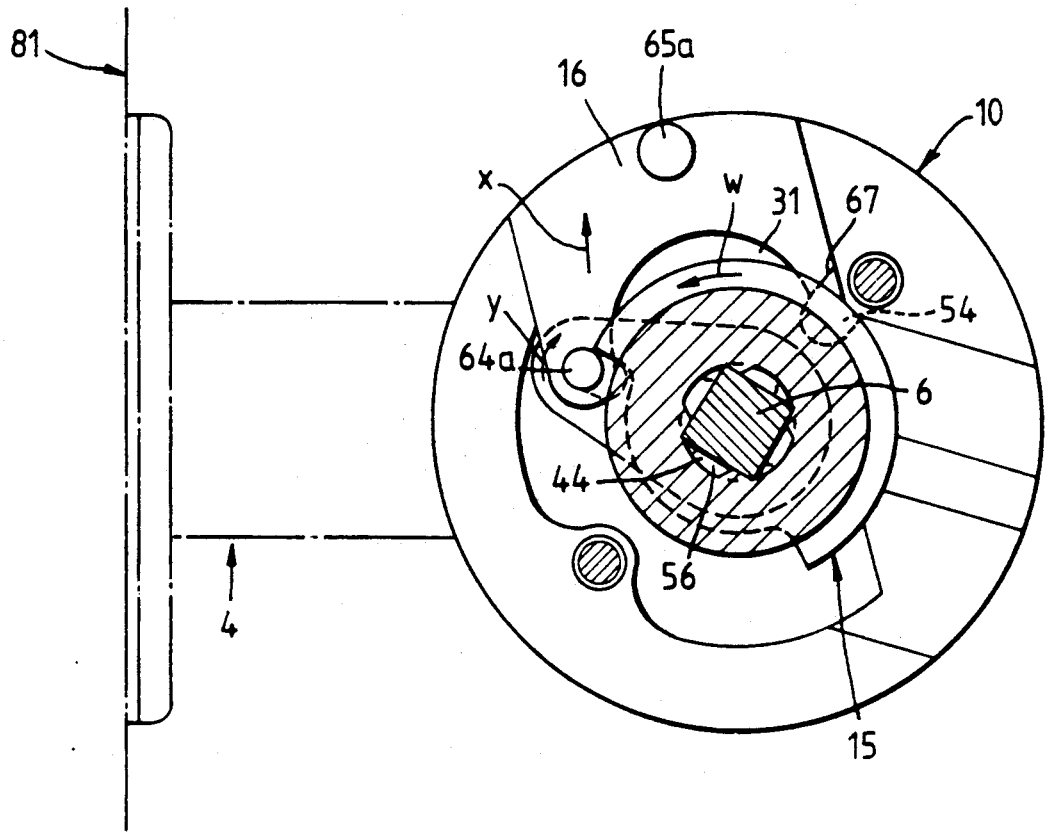
FIG. 17 a view corresponding to FIG. 15 in an open position of the lock follower according to FIG. 1 produced by turning the handle in anticlockwise sense.

FIG. 1 shows a door 1 with a lock mortice 2, in which is arranged a door lock, not shown in more detail, with a follower 3 which is coupled in the usual manner through a shank 4 to a closure member 5 in the form of a bolt or a catch schematically shown in FIGS. 15 to 17. The follower 3 is passed through by an operating rod 6, whose ends project into fittings 7 and 8 fixed on both sides of the door 1. The operating rod 6 is so interlocked in he follower 3 that it follows this in interlocked manner both with rotation in the clockwise sense (turning right), hereinafter called the first direction, and with rotation in the anti-clockwise sense (turning left), hereinafter called the second direction. The fitting 7 includes a handle 9, a fixing device, which serves for rotary mounting of the handle 9 and for fixing the fitting 7 on to the door 1, and the one half of the operating rod 6. The handle 9 is preferably formed as a spherical knob but can also take any other form and also be formed as a lever handle. The other fitting is correspondingly formed and comprises the other half of the operating rod 6, so that only the fitting 7 is described below.

The fixing device includes in substance an under part 10, a top part 11 and a transmission mechanism 12 arranged between the two, which mechanism comprises for its part in substance a follower element 14, an adaptor piece 15 and a transmission element 16. The adaptor piece 15 can be a part of the handle 9 or a separate part fitted therein. Moreover the fixing device preferably comprises a cover 17 which covers the other parts. The fixing device and the transmission mechanism 12 are so formed and arranged that, on turning the handle 9 in one of the two directions, the operating rod 6 is turned directly in this direction of rotation while, on turning the handle 9 in the other direction of rotation, it is decoupled from this and instead turned likewise in the first said direction with the aid of the transmission mechanism 12. The direction of rotation of the operating rod 6 is thus independent of which direction of rotation the handle 9 turns in, staying the same.

Particularities of the fixing device and the transmission mechanism 12 will now be explained in more detail with reference to FIGS. 2 to 14.

Figure 2:
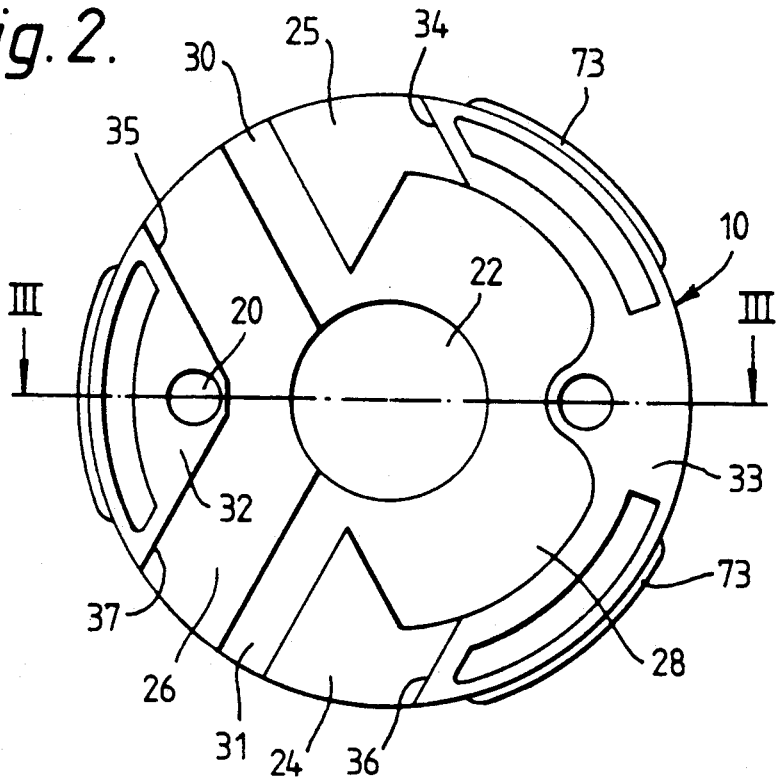
FIG. 2 a plan view of an under part of the fitting according to FIG. 1.
Figure 3:
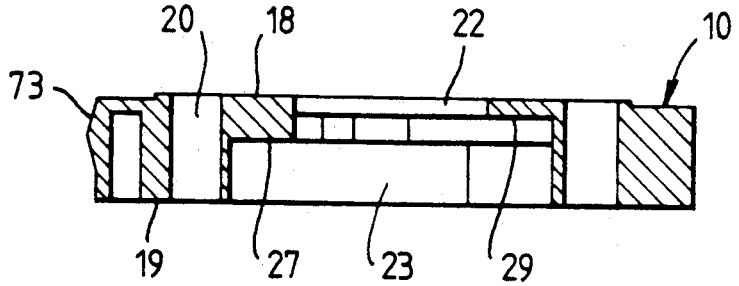
FIG. 3 a section along the line III—III of FIG. 2.

According to FIGS. 2 and 3 the under part 10 consists of a preferably circular plate which has on its underside a substantially flat mounting surface 18, an upper side 19 and through holes 20 at the edge for fixing screws 21. These can be screws which firmly connect together the under parts 10 bearing on both sides of the door 1 with their mounting surfaces 18 according to FIG. 1 and thus fix both fittings 7 and 8 also to the door 1.

The under part 10 further comprises a through, cylindrical, advantageously centrally arranged bearing opening 22 and a recess formed from the upper side 19, extending partially up to the bearing opening 22, with a cross-section greater than that of the bearing opening 22. The recess 23 extends in the region of segments 24, 25 and 26 (FIG. 2) from the upper side 19 up to a first plane 27 (FIG. 3) and in the region of a segment 28 (FIG. 2) from the upper side 19 up to a second plane 29 (FIG. 3) closer to the mounting surface 18. Moreover the sections 24 and 26 bound a guide groove 30 and the sections 25 and 26 a guide groove 31. Both guide grooves run radially to the centre point of the circular under part 10. Finally there are provided two segments 32, 33 surrounding the two holes 20 extending the full thickness of the under part 10. At their ends are respective pairwise opposed, flat guide surfaces 34, 35 and 36, 37 respectively, the guide surfaces 34, 35 being arranged on the two sides of the guide groove 30 and parallel thereto while the guide surfaces 36, 37 run on the two sides of the guide groove 31 and parallel thereto. The whole under part 10 is preferably made in one piece from plastics material by injection moulding.

Figure 5:
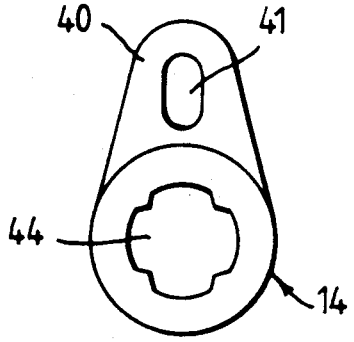
FIGS. 4 and 5 an elevation and plan view of a follower element of the fitting according to FIG. 1.
Figure 4:
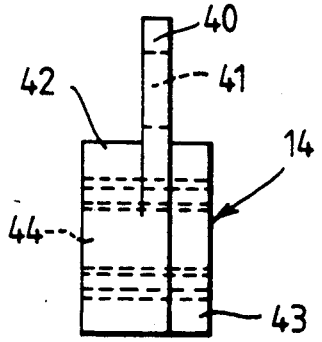

The follower element 14 consists according to FIGS. 4 and 5 in substance of a sleeve-like body and a lever arm 40 projecting radially outwards therefrom, which arm is provided with a radially disposed slot 41. The follower element 14 comprises at its one axial end an outwardly cylindrical bearing section 42, whose external cross-section corresponds substantially to the inner cross-section of the bearing opening 22 of the under part 10. At the other end the follower element 14 has an outwardly likewise cylindrical bearing section 43. An inner, axial passage 44 of the sleeve-like body serves to receive the operating rod 6 in such a way that, as will be described below, the latter can be rotated to and fro to a limited degree in the passage 44.

Figure 6:
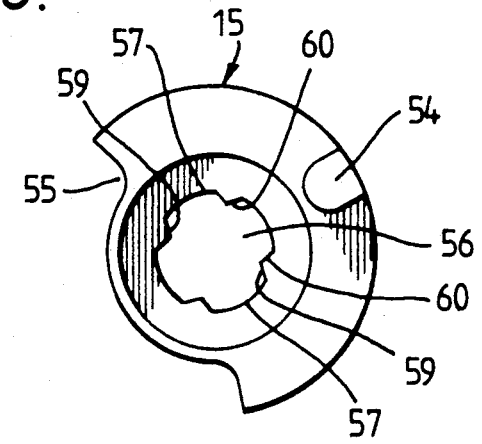
FIGS. 6 to 8 an underplan, elevation and plan view of an adaptor piece of the fitting according to FIG. 1.
Figure 7:
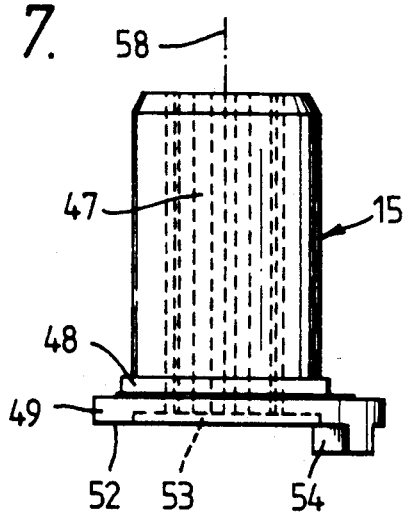
Figure 8:
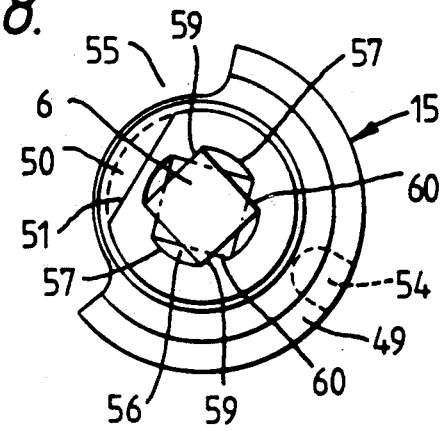

The adaptor piece 15 comprises according to FIGS. 6 to 8 a mounting section, a cylindrical collar 48 connected thereto and a flange 49 following this. The mounting section 47 is substantially cylindrical but, in accordance with FIG. 8, provided with a cutout 50, which has an segmental cross-section, extends over the whole length of the mounting section 47 and forms a flat outer wall 51. The collar 48 has a somewhat larger outer diameter than the mounting section and serves as a bearing section, while the outer cross-section of the flange 49 is still greater than that of the collar 48. The flange has a cylindrical recess 53 in its end face 52 directed away from the collar 48, the inner cross-section section of which corresponds substantially to the outer cross-section of the bearing section 43 of the follower element 14. Moreover the flange 49 is provided with a transmission pin 54 standing substantially perpendicular from the end face 52, the cross-section of the pin being indicated in broken lines in FIG. 8. Finally a cutout 55 is formed at the edge of the flange 49 extending over approximately 120°.

Finally the adaptor piece 15 comprises a receiving opening 56 for the operating rod 6 extending to the end face 52, coaxial with the mounting section 47. The cross-section of this receiving opening 56 is identical to the cross-section of the passage 44 of the follower element 14 and in accordance with FIGS. 5, 6 and 8 cross or star shaped for example. Thus this cross-section is so chosen that the operating rod 6—considered in relation to its direction of rotation about its axis—is arranged with a certain play in the receiving opening 56. To this end the receiving opening 56 when using an operating rod 6 of square cross-section, i.e. the usual square spindle, is delimited for example by four walls 57 running along cylindrical surfaces, whose radius measured from the central axis 58 of the adaptor piece 15 is substantially equal to half the diagonal through the cross-section of the operating rod 6. These walls 57 are uniformly spaced in the circumferential direction, each extend over about 60° for example and are delimited at their ends by inwardly projecting stop surfaces 59 or 60. The rearward projections of the two stop surfaces 59, 60 of each wall 57 each include an angle of e.g. about 30°. Accordingly the operating rod 6 can according to FIG. 8 turn for example from a datum position (full-line showing), in which it bears against the stop surfaces 59, in clockwise direction through about 60° into a position which is shown in FIG. 8 in broken lines and in which it bears against each of the stop surfaces 60. Conversely the adaptor piece 15 can, commencing from its datum position shown in FIG. 8 and with the operating rod 6 in the full line position, be turned through about 60° in anticlockwise direction, without thereby acting on the operating rod 6. Accordingly the adaptor piece 15—commencing from its datum position—can only transmit a rotational movement to the operating rod 6 following the first direction of rotation, while in the second direction of rotation, commencing from the same datum position, it can exert no influence on the operating rod 6, on account of the described play or lost motion at least within a predetermined range of rotation amounting in the illustrated example to about 60°. The position and arrangement of the stop surfaces 59, 60 are thus to be so chosen for the particular case and in dependence on the cross-sectional form of the operating rod 6, that this can be turned to and fro at will in the predetermined range.

The same applies in the mounted condition likewise to the follower element 14 passed through by the operating rod 6, with preferably the same cross-section for its passage 44 as has the receiving opening 56 of the adaptor piece 15.

Figure 10:
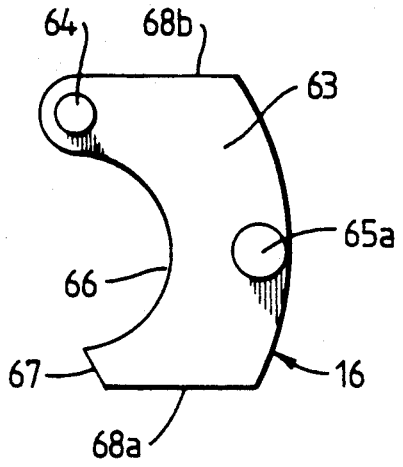
FIGS. 9 and 10 an elevation and plan view of a transmission element of the fitting according to FIG. 1.
Figure 9:
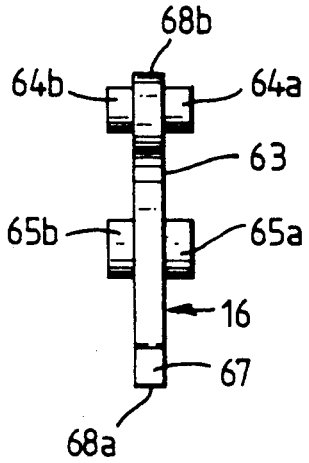

According to FIGS. 9 and 10 the transmission element 16 consists in substance of a flat parallel plate 63, from one surface of which project, each perpendicularly, a follower pin 64*a* and a guide pin 65*a*. From corresponding locations on the other surface of the plate 63 there project correspondingly a follower pin 64*b* and a guide pin 65*b*. Moreover the plate 63 is formed approximately U-shaped and accordingly provided with a cutout 66, the follower pins 64*a,b* being arranged in a longitudinal arm and the guide pins 65*a,b* in the transverse arm. At the end of the other longitudinal arm of the plate 63 there is formed an obliquely running end face 67. Outer surfaces 68*a,b* of the longitudinal arms are according to FIG. 10 formed flat and parallel to one another as well as parallel to the axes of the follower and guide pins 64 and 65 respectively.

The follower element 14, the adaptor piece 15 and the transmission element 16 are each preferably made in one piece from plastics material by injection moulding.

Figure 11:
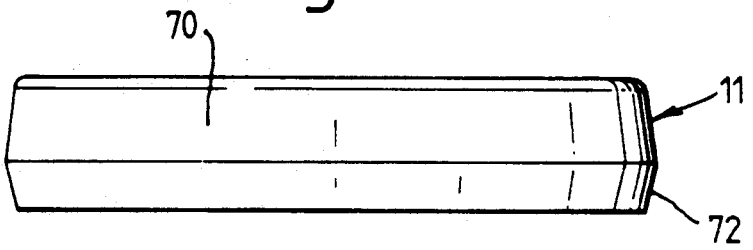
FIGS. 11 and 12 an elevation and plan view of a top part of the fitting according to FIG. 1.
Figure 12:
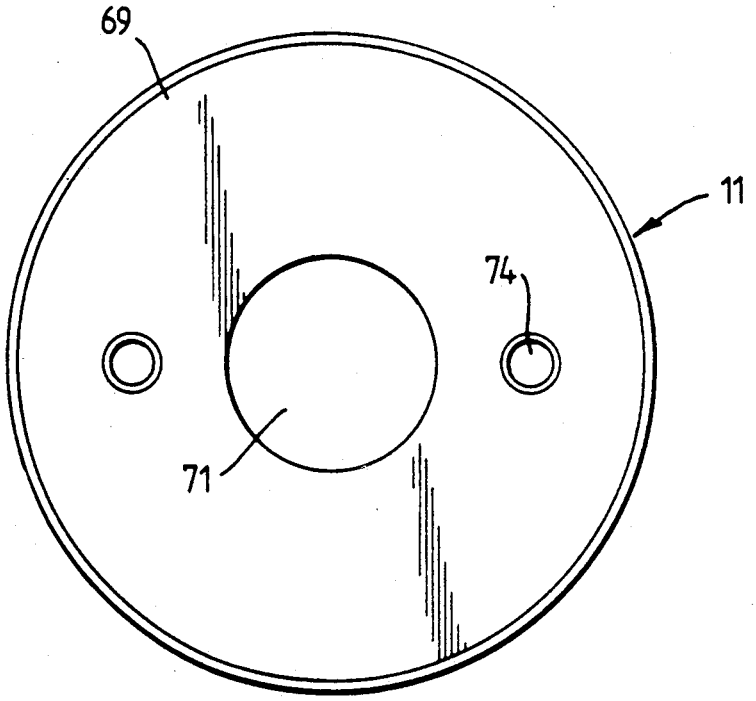

FIGS. 11 and 12 show that the top part 11 is formed like a cap and preferably consists of a circular disc 69, on one side of which a cylindrical peripheral wall 70 is formed. In the disc 69 there is formed a circular bearing opening 71, whose diameter corresponds substantially to the diameter of the collar 48 of the adaptor piece 15. The top part 11 is preferably made from steel. The inner cross-section of the peripheral wall 71 corresponds substantially to the outer cross-section of the under part 10, so that this can be fitted as a whole into the peripheral wall 70 according to FIG. 1. Undercuts or projections 72 or 73 respectively (FIGS. 1 to 3) can be formed on the inner wall of the peripheral wall 70 and on the outer periphery of the under part 10, which hold the top part 11 on the under part 10 so that it cannot be lost or fix it thereto. Moreover the top part 11 has holes 74 which lie in corresponding places to the holes 20 of the under part 10 and serve for the passage of the fixing screws 21.

Figure 13:
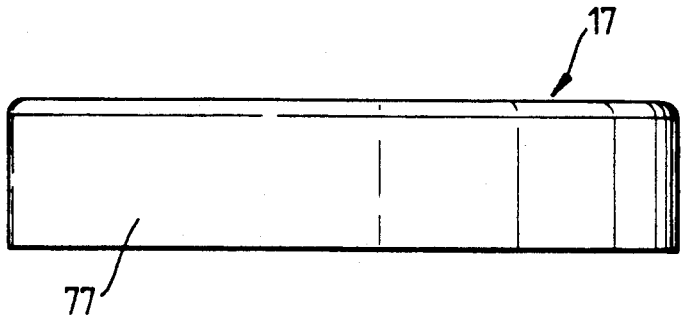
FIGS. 13 and 14 an elevation and plan view of a cover of the fitting according to FIG. 1.
Figure 14:
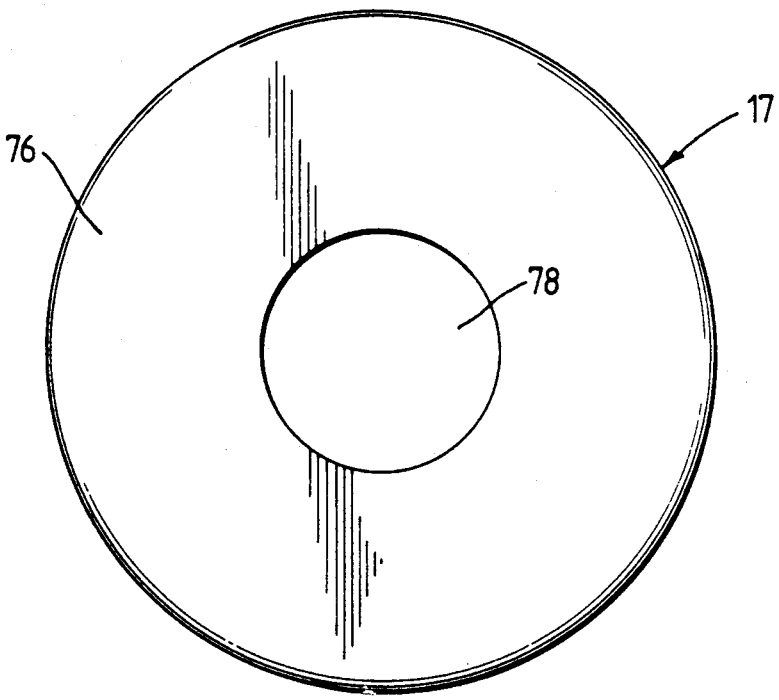

The cover 17 is likewise formed as a cap according to FIGS. 13 and 14. It consists of a flat parallel disc 76 with a cylindrical peripheral wall 77 formed on one side and serves according to FIG. 1 to cover the whole fixing device. Thus the disc 76 has a circular centre hole 78, whose diameter corresponds to the diameter of a cylindrical extension 79, which is attached to the grip part 80 of the handle 9.

The assembly of the described parts appears from FIGS. 1 and 15. The under part 10, the top part 11, the follower element 14, the adaptor piece 15 and the transmission element 16 of the fitting 7 (FIG. 1) are already connected together at the factory to a pre-assembled unit. Thus firstly the follower element 14 is fitted with its bearing section 42 in the bearing opening 22 of the under part 10, until the lever arm 40 lies on the segment 28. Then the transmission element 16 is so fitted that it has its one guide pin 65*b* in the guide groove 31 of the under part 10 and at the same time the follower pin 64*b* in the slot 41 of the follower element 14. It would also be possible to form the follower pins 64*a,b* on the follower element 14 and the slot 41 on the transmission element 16. In this position the cutout 66 (FIG. 10) of the transmission element 16 embraces the other bearing section 43 of the follower element 14. Thus the transmission element 16 lies with one of its broad sides on the associated segments 24, 26 and with sliding seating and is at the same time radially slidably mounted on the one hand with its outer surfaces 68*a,b* between the corresponding guide surfaces 36, 37 (FIG. 2) of the under part 10 and on the other hand with one of the guide pins 65*b* in the corresponding guide groove 31.

The adaptor piece 15 is now so fitted that its recess 53 receives the part of the bearing section 43 projecting beyond the transmission element 16, so that this is thus rotatably mounted in the adaptor piece 15 and the under part 10. The rotational position of the adaptor piece 15 is so chosen that the transmission pin 54 comes to lie opposite the end face 64*a* of the transmission part 16 and at the same time the follower pin 64*a* not arranged in the slot 41 lies in the cutout 55 of the flange 49. The guide pin 65*a* not arranged in the guide groove 31 then lies radially outside the flange 49 in the recess 23 of the under part 10, so that the plate 63 of the transmission element 16 is partially overlapped by the flange 49 and is thus also guided with a sliding seat between the latter and the lever arm 40 of the follower element 14.

The axial lengths of the various parts are so chosen that in its position now produced, the flange 49 of the adaptor piece lies wholly within the recess 23 of the under part 10, whereas its collar 48 lies a least partially outside this recess 23.

The top part 11 is now tilted on the under part 10 and the transmission mechanism 12 in the manner apparent from FIG. 1. The axial length of its peripheral wall 70 is so dimensioned that this adjoins the mounting surface 18 of the under part 10 on engagement of the snap connection between the undercuts 72 and projections 73 and at the same time the collar 48 of the adaptor piece 15 is mounted rotatably in the bearing opening 71 of the top part 11.

At the place of installation it is merely necessary to introduce the operating rod 6 into the follower 3 and then fit thereon from the two sides of the door 1 one each of the pre-assembled units, so that it bears with its outer faces on the stop surfaces 59 of the adaptor piece 15 or the corresponding stop surfaces of the follower element 14. The two units are then screwed together by means of the fixing screws 21, whereafter the covers 17 are pressed on and attached to the top part 11 by means of a snap connection or by a press fit. The cover 17 thus has its central hole on the extension 79 of the handle 9, the outer diameter of the extension 79 advantageously being somewhat larger than the outer diameter of the collar 48. Finally the handles 9 are pushed on to the mounting sections 47 of the adaptor pieces 15. Thus the extension 79 has a receptacle for the mounting section 47 with the same cross-section, so that a rotation-fast connection is made between the handle 9 and the adaptor piece 15 with the aid of the outer wall 51 (FIG. 8) and a corresponding inner wall in this receptacle. The cross-sections of the receptacle and the mounting section 47 are so chosen that there is a firm press tit and the handle 9 cannot readily be pulled off. If necessary a detent device acting between the two can be provided.

The described assembly sequence is only to be taken as an example. Other assembly sequences are possible.

The mode of operation of the described fitting 7 is as follows:

FIG. 15 shows the datum position of the various parts. In this the passage 44 and the receiving opening 56 are aligned and the operating rod 6 is so arranged that it bears on the stop surfaces 59 of the receiving opening 56. At the same time the transmission pin 54 lies practically against the end face 67. The closure member 5 is in its closed position, in that it projects beyond a schematically shown end wall 81 of the door, into a corresponding receptacle of a door plate or the like, not shown.

By turning the handle 9 in a first direction of rotation (arrow v in FIG. 16) the adaptor piece 15 and its flange 49 visible in FIGS. 15 and 16 are likewise turned in the first direction. A turning moment is thereby transmitted by the stop surfaces 59 directly to the operating rod 6. Accordingly this, and therewith the follower 3 passed through thereby without play, are likewise turned in the direction of the arrow v, until the position according to FIG. 16 is attained after a rotation of about 30°. This suffices in the chosen example to withdraw the closure member 5 completely behind the end wall 81. All other parts remain in the position seen in FIG. 15, because the operating rod 6 driven by the adaptor piece 15 in the first direction of rotation can turn freely in the passage 44 of the follower element 14. This is indicated in FIG. 16 by a broken line cross-section of the passage 44 of the follower element 14. Moreover it can be provided that the cutout 55 in the flange 49 is so dimensioned in the peripheral direction that its one end abuts the free follower pin 64*a,b* in the position according to FIG. 16 and thus makes further turning of the handle 9 impossible.

After releasing the handle 9 the datum position according to FIG. 15 is obtained again by means of the usual springs acting on the follower 3, which are arranged in the lock and not shown, in that the follower 3 turns the operating rod 6 back again and this turns with it the adaptor piece 15 and the handle 9 through the stop surfaces 59.

From the datum position according to FIG. 15 a rotation of the follower 3 in the first direction of rotation (arrow v in FIG. 16) can likewise be obtained by rotating the handle 9 or the adaptor piece 15 in the second direction of rotation (arrow w in FIG. 17). In this case the transmission mechanism 12 is operative. i.e. the turning moment is not transmitted directly to the follower 3 by the handle 9 but indirectly through the transmission mechanism 12. The rotation of the adaptor piece 15 in the direction of the arrow w (FIG. 17) thus remains without effect on account of the described lost motion, with the consequence that the stop surfaces 59 retract from the operating rod 6 without affecting it. However at the same time the rotation of the adaptor piece 15 in the direction of the arrow w has the result that its transmission pin 54 presses against the end face 67 of the transmission element 16 and thereby displaces this in the direction of an arrow x (FIG. 17). whereby the follower element 14 is rotated in the direction of an arrow y (FIG. 17) through the associated follower pin 64*a,b*. Since at this time the stop surfaces of the follower element 14 corresponding to the stop surfaces 59 bear on the operating rod 6, this is likewise turned in the direction of the arrow y corresponding to the first direction and thereby operates the follower 3 on the sense of the opening movement for the catch 5 or the shank 4. Such a rotation of the operating rod 6 is possible until this abuts the stop surfaces 60 of the adaptor piece 15 turning in the opposite direction, as is indicated in FIG. 17 by the full line showing of the receiving opening 56 and the broken line showing of the passage 44. This occurs after a rotation of about 30°, since the lost motion of the operating rod 6 in the receiving opening 56 in the selected example amounts to about 60°. If the handle 9 is then released the lock spring returns all the parts involved to the datum position according to FIG. 15, through the follower 3, the operating rod 6 and the follower element 14.

Alternatively the rotary movement of the handle 9 in the second direction of rotation can also be limited in that the transmission element 16 abuts with its radially outwardly lying section on the top part 11 surrounding the under part 10 or the other end of the cutout 55 of the flange 49 bears on the free follower pin 64*a,b*.

Figure 15A:
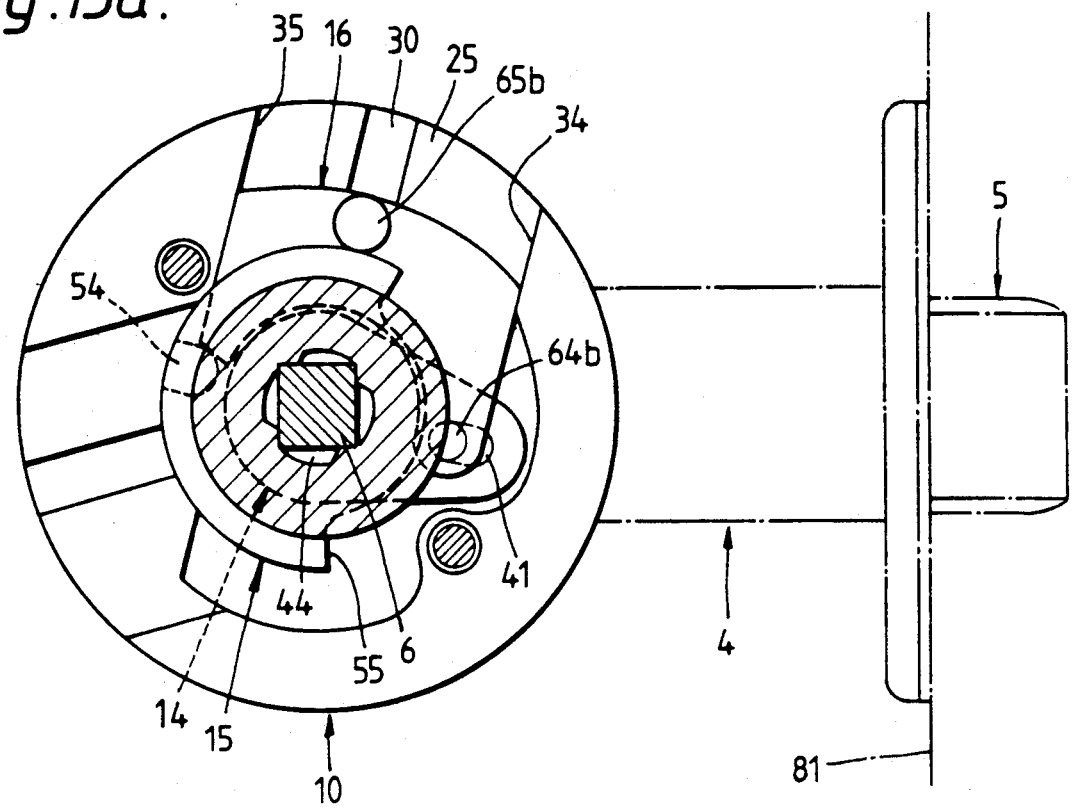
FIG. 15*a* a view corresponding to FIG. 15 approximately in section along the line XV*a*-XV*a* of FIG. 1.
Figure 16A:
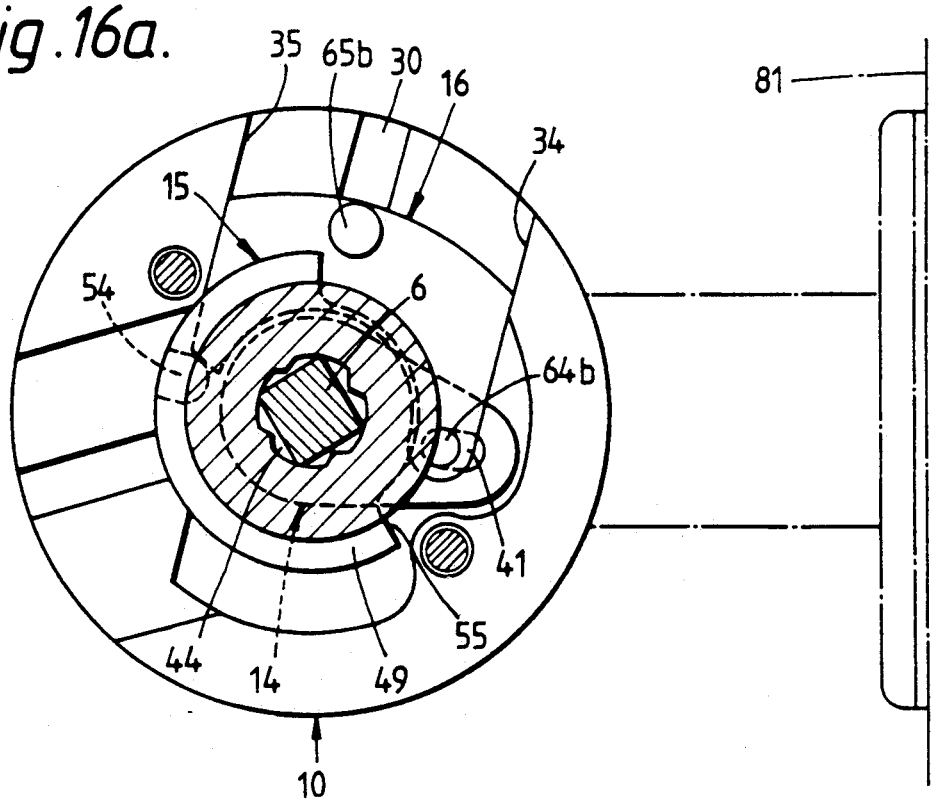
FIG. 16*a* a view corresponding to FIG. 16 approximately in section along the line XV*a*-XV*a* of FIG. 1.

From FIGS. 15*a* and 16*a* it can be seen that, in the opposite fitting 8 (FIG. 1), the arrangement is so selected, in contrast to FIGS. 15 and 16, that the transmission element 16 is guided between the guide surfaces 34 and 35 of the under part 10 and in consequence its guide pin 65*a* is arranged in the guide groove 30. The follower element 14 and the adaptor piece 15 are correspondingly turned, so that the follower pin 64*a* enters the slot 41 and the cutout 55 can be arranged in the region of the free follower pin 64*b*. On account of the special formation of the under part 10, the follower element 14, the adaptor piece 15 and the transmission element 16, completely structurally alike parts can be used on both sides of the door 1, although it would naturally also be possible to provide at least different under parts 10 or transmission elements 16. The pre-assembly of the fitting 8 takes place like the fitting 7.

A comparison of FIGS. 15. 15*a* and 16, 16*a* further shows that the described movements of the fitting 7 (FIGS. 1, 15, 16) have no influence on the fitting 8 (FIGS. 1, 15*a*, 16*a*), i.e. the respective non-operated handle 9 stays in its datum position. This follows in that, the rotation of the operating rod 6 in the first direction of rotation effected in the transition from FIG. 15 to FIG. 16 corresponds in the view of FIGS. 15*a*, 16*a* to a rotation in the opposite, second direction. Such a rotation has according to FIG. 16*a* only the result that the lost or free motion in the passage 44 of the follower element 14 or in the receiving opening 56 of the adaptor piece 15 is effective, so that no turning moment can be transmitted from the operating rod 6. This is correspondingly true when the right handle 9 in FIG. 1 is turned in the second direction of rotation in accordance with FIG. 17, because according to the above description such a movement also results in a rotation of the operating rod 6 in the first direction of rotation.

The described arrangement thus brings With it the additional advantage that the respective non-operated handle 10 remains in its datum position and is not turned together with the respective operated handle. It is therefore not possible to determine on the basis of this otherwise customary turning in sympathy, whether the handle on the other side of the door is being operated or not at the moment. If handles, e.g. door lever handles, are used which could participate undesirably in such a turning movement on account of their weight, it can additionally be provided to make this movement impossible by springs built into the fitting.

Figure 18:
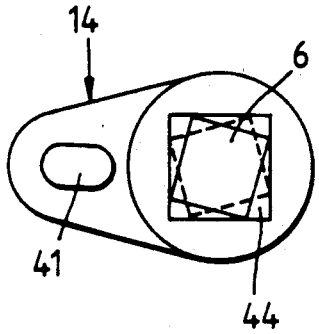
FIG. 18 a view corresponding to FIG. 5 of an alternative embodiment of the follower element.

The invention is not limited to the described embodiment, since it can be modified in many ways. For example the receiving opening 56 of the adaptor piece 15 and the passage 44 of the follower element 14 could have cross-sections other than those shown. According to FIG. 18 the passage 44 has e.g. a square cross-section which is however larger than the likewise square cross-section of the operating rod 6. The side of the passage 44 is smaller than a diagonal through the cross-section of the operating rod 6, so that the two extreme positions shown in FIG. 18 in full and broken lines respectively result, between which the operating rod 6 can be turned freely to and fro. The receiving opening 56 of the adaptor piece 15 can in this case likewise be formed as in FIG. 18 but it would also be possible to give the passage 44 and the receiving opening 56 different cross-sections. The choice of these cross-sections depends in substance on the desired rotational ranges in which turning moments are to be transmitted and in which lost motion is desired. Correspondingly, ranges of rotation other then 60° can be provided for the lost motion, since the lost motion angle depends essentially on how far the handle 9 has to be turned in order to open the closure member 5.

Furthermore it would be possible to make the handle 9 and the adaptor piece 15 in one. In this case the receiving opening 56 would be an integral part of the handle 9 and not of the adaptor piece 15. In this other transmission mechanisms could be provided, in order to convert a rotary movement of the handle in one direction into a rotary movement of the operating rod in the opposite direction of rotation. The described embodiment has however the advantage that the complete fixing device is very flat and can therefore be formed externally as a conventional rosette or the like.

I claim:

1. A fitting for operating a lock fitted in a door or the like, said lock having a lock follower rotatably mounted therein, and an operating rod passing through said lock follower for rotating the same, said fitting comprising: an adapter means having a receiving opening for receiving an end of said operating rod, said receiving opening being formed such that said adapter means is adapted, in going from a datum position, to transfer directly to said operating rod a rotary movement taking place in a first direction of rotation, a fixing means for rotatably mounting said adapter means to said door or the like such that said adapter means is rotatable in said first direction and a second opposite direction of rotation; and a transmission mechanism coupled with said adapter means and said operating rod such that a rotary movement of said adapter means in said second direction of rotation, commencing from the datum position, is converted into a rotary movement of the operating rod likewise taking place in the first direction of rotation.

2. A fitting according to claim 1, wherein the transmission mechanism includes a follower element coupled to the operating rod and a transmission element coupled to said adapter means and the follower element.

3. A fitting according to claim 2, wherein the follower element is rotatably mounted in the fixing means and has a passage passed through by the operating rod, said transmission element being so formed and arranged that the same converts rotary movements of said adapter means, taking place in the second direction of rotation, into a rotary movement of the follower element taking place in the first direction of rotation, said passage of said follower element being so formed that rotary movements of the follower element caused by said adapter means and taking place in the first direction of rotation are transferred to the operating rod, whereas the operating rod is uninfluenced by rotary movements of the adapter means taking place in the opposite direction of rotation, commencing from the datum position, at least within a predetermined range of rotation.

4. A fitting according to claim 1, wherein the transmission mechanism includes a follower element coupled to the operating rod and a transmission element coupled to said adapter means and the follower element, wherein the fixing means comprises an under-part adapted to be fixed to the door or the like and a top-part rotatably carrying said adapter means and adapted to fit on the under-part, and wherein the transmission mechanism is arranged between the two parts.

5. A fitting according to claim 4, wherein the under-part comprises a mounting surface to be positioned on the door, an upper side, a recess adjoining the upper side and a cylindrical bearing opening adjoining the recess and the mounting surface, and wherein the follower element comprises a sleeve-like body, which has a bearing section rotatably mounted in the bearing opening and a radially projecting lever-arm, in the recess in an assembled state of the follower element.

6. A fitting according to claim 5, wherein the transmission element is mounted in the recess so as to be radially displaceable relative to the operating rod, is pivotally connected to the lever arm and is provided with an end face, and wherein the adapter means has a transmission pin associated with the end face, said pin bearing against said end face with rotation of said adapter means in the second direction of rotation for forcing the transmission element radially outwardly.

7. A fitting according to claim 6, wherein the under-part and the transmission element are provided with corresponding guides.

8. A fitting according to claim 4, wherein the adapter means comprises a flange arranged between the top part and the under-part and a cylindrical collar, and wherein the top part has a cylindrical bearing opening in which the collar is rotatably mounted.

9. A fitting according to claim 8, wherein the flange has a cylindrical recess on a side facing the following element, and wherein the follower element has a further, cylindrical bearing section rotatably mounted in the recess.

10. A fitting according to claim 9, wherein the transmission element is arranged between the flange and the follower element and has a cutout adjacent to the further bearing section.

11. A fitting according to claim 6, wherein the adapter means comprises a flange arranged between the top part and the under-part and a cylindrical collar, wherein the top part has a cylindrical bearing opening in which the collar is rotatably mounted, and wherein the transmission pin of said adapter means is formed on a side of the flange facing the follower element.

12. A fitting according to claim 6, wherein the lever arm and the transmission element are connected by a slot formed in one of said lever arm and transmission element, and a follower pin located on the other one of said lever arm and transmission element and extending through the slot.

13. A fitting according to claim 3, wherein the receiving opening of the adapter means and the passage of the follower element have the same cross-section and are arranged in register with each other in the datum position.

14. A fitting according to claim 1 for operating a lock having a square operating rod, wherein said receiving opening has a star- or cross-shaped cross-section.

15. A fitting according to claim 1, 3 or 14, for operating a lock having a square operating rod, wherein said passage has a star- or cross-shaped cross-section.

16. A fitting according to claim 1 for operating a lock having a square operating rod, wherein said receiving opening has a square cross-section which is larger than the cross-section of the square operating rod, and a side length which is smaller than a diagonal of the square operating rod.

17. A fitting according to claim 1, 3 or 14, for operating a lock having a square operating rod, wherein said passage has a square cross-section which is larger than the cross-section of the square operating rod, and a side length which is smaller than a diagonal of the square operating rod.

18. A fitting according to claim 1, wherein a handle is provided for operating said lock, said handle being coupled to said adapter means.

19. A fitting according to claim 1, wherein a handle is provided for operating said lock, wherein said adapter means comprises a mounting section, and wherein said handle comprises a grip part and an extension mounted on said mounting section.

20. A fitting according to claim 1, wherein a handle is provided for operating said lock, said handle and said adapter means being one piece.

* * * * *